US005177505A

United States Patent [19]

Sugiura et al.

[11] Patent Number: 5,177,505

[45] Date of Patent: Jan. 5, 1993

[54] INK JET PRINTER PRINT HEAD CLEANING APPARATUS AND METHOD

[75] Inventors: Toshiaki Sugiura, Hekinan; Mamoru Imaizumi, Nagoya, both of Japan

[73] Assignee: Brother Kogyo Kabushiki Kaisha, Nagoya, Japan

[21] Appl. No.: 721,302

[22] Filed: Jun. 26, 1991

[30] Foreign Application Priority Data

Oct. 2, 1990 [JP] Japan ..... 2-265540

[51] Int. Cl.[5] ..... B41J 2/165

[52] U.S. Cl. ..... 346/140 R

[58] Field of Search ..... 346/140 R, 75; 400/126, 400/701, 702, 55, 59, 702.1

[56] References Cited

U.S. PATENT DOCUMENTS

| | | | |
|---|---|---|---|
| 4,571,601 | 2/1986 | Teshima | 346/140 R |
| 4,727,437 | 2/1988 | Mizoguchi | 358/304 |
| 4,907,013 | 3/1990 | Hubbard et al. | 346/1.1 |
| 4,947,190 | 8/1990 | Mizusawa et al. | 346/140 R |
| 4,990,004 | 2/1991 | Kawahara et al. | 400/56 |

FOREIGN PATENT DOCUMENTS

| | | | |
|---|---|---|---|
| 0032068 | 2/1987 | Japan | 346/140 R |
| 0297172 | 12/1987 | Japan | 400/701 |

*Primary Examiner*—Benjamin R. Fuller
*Assistant Examiner*—N. Le
*Attorney, Agent, or Firm*—Oliff & Berridge

[57] ABSTRACT

An ink jet printer having a pressing mechanism for pressing a print head against a sheet of paper set on a platen by rotating an eccentric shaft, a driver for feeding the paper under the condition where the print head is in pressure contact with the paper to carry out cleaning of the print head, a photosensor for detecting whether or not the paper is present at a printable position, and an eject controller for ejecting the paper after carrying out test printing of a plurality of predetermined characters on the paper when the sufficient remaining paper is detected after ending the cleaning of the head or, alternatively, ejecting the paper without carrying out the test printing when it is determined there is insufficient paper detected after ending the cleaning of the head.

7 Claims, 7 Drawing Sheets

FIG.6B

| | |
|---|---|
| S601 | PAPER DETECTED ? |
| S602 | FEED PAPER UNTIL PAPER IS DETECTED |
| S603 | FEED PAPER BY THE FIRST PREDETERMINED AMOUNT |
| S604 | MOVE CARRIAGE |
| S605 | PRESS HEAD |
| S606 | FEED PAPER BY THE SECOND PREDETERMINED AMOUNT |
| S607 | RELEASE HEAD |
| S608 | RETURN CARRIAGE AND FEED PAPER BY ONE LINE |
| S609 | PAPER DETECTED ? |
| S610 | WRITE PRINT DATA |
| S611 | PRINTING |
| S612 | ALL PRINT DATA WRITTEN ? |
| S613 | EJECT PAPER |

INK JET PRINTER PRINT HEAD CLEANING APPARATUS AND METHOD

BACKGROUND OF THE INVENTION

1. Field of the Invention

The present invention relates to an ink jet printer having an ink jet head for injecting ink onto printing paper to carry out printing.

2. Description of Related Art

In recent years, an on-demand type ink jet printer has been in use because it has various advantages such as high printing speed, low noise, easy color printing, simple construction, and low price. An ink jet printer of this type includes an ink jet head provided at its front end with a plurality of nozzles arranged vertically. The ink jet head is adapted to slide along a guide bar extending parallel to a platen. Liquid ink particles are ejected from selected nozzles as appropriate for the print task as the ink jet head slides along the guide bar to thereby carry out printing on the printing paper set on the platen.

In such a conventional ink jet printer, there is the possibility of a stain or blot caused by ink residue attached to the nozzles of the ink jet head or a clogging of the nozzles that results in a reduction in the print quality. To cope with this disadvantage, it has been proposed to provide a special mechanism for cleaning the ink jet head as disclosed in U.S. Pat. No. 4,571,601, for example. This cleaning mechanism is provided with a wiping member such as paper, cloth or rubber member for wiping off the residue attached to the nozzles of the ink jet head. Thus, the nozzles of the ink jet head are cleaned periodically or as required by the cleaning mechanism.

However, in this prior art ink jet printer employing the cleaning mechanism, the wiping member also becomes dirty and must therefore be replaced by a new wiping member. Accordingly, the operator must carry out the troublesome task of replacing the wiping member. Further, because the cleaning mechanism is provided independently of the printing mechanism, the overall structure of the printer is complicated causing an increase in cost.

Further, to confirm whether of the cleaning is satisfactory, it is necessary to actually execute printing following the cleaning. In this circumstance, a test print is carried out on printing paper, after ending the cleaning, to confirm whether the result of the cleaning is satisfactory, that is, whether characters are properly printed. Accordingly, not only is the wiping member wastefully used but so too is the printing paper for the test print thereby uneconomically increasing operating costs.

SUMMARY OF THE INVENTION

An object of the present invention is to provide an ink jet printer which can clean the ink jet head at a low cost having a simple structure and yet eliminates the troublesome tasks associated with the cleaning of the ink jet head.

Another object of the present invention is to provide an ink jet head which enables an operator to easily and surely confirm the result of the cleaning of the ink jet head, and economically suppresses the operating costs for the processes of cleaning and confirming the result of the cleaning.

The ink jet printer of the present invention comprises a paper supporting mechanism for supporting the printing paper, an ink jet head for injecting ink onto the printing paper supported by the paper, instruction means for instructing the cleaning of the ink jet head, a pressing mechanism for effecting pressure contact between the ink jet head and the printing paper in response to an instruction from the instruction means, a slide moving mechanism for effecting relative sliding movement of the ink jet head and the printing paper under the pressure contact condition effected by the pressing mechanism, restoring means for restoring the distance between the ink jet head and the printing paper to the distance predetermined for regular printing after the relative sliding movement effected by the slide moving mechanism, a regular moving mechanism for effecting relative movement of the ink jet head and the printing paper under the condition where the distance between the ink jet head and the printing paper is equal to the predetermined distance, storing means for storing print data, paper detecting means for detecting whether the printing paper is present at a printable position, reading means for reading the print data stored in the storing means when the printing paper is detected as present by the paper detecting means after a restoring operation effected by the restoring means, and printing means for printing the print data read above by driving the ink jet head over a portion of the printing paper immediately following and below a relative sliding moving area of the printing paper defined by the slide moving mechanism while the ink jet head and the printing paper are being relatively moved by the regular moving mechanism, thereafter ejecting the printing paper, and print canceling means for ejecting the printing paper without printing the print data when the presence of the printing paper is not detected by the paper detecting means thereby indicating insufficient printing paper for a test print.

With this construction, every time the cleaning of the ink jet head is instructed by the instruction means, the ink jet head and the printing paper ar brought into relative pressure contact with each other, and they are slid relative to each other under the pressure contact condition thereby wiping off any residue attached to the ink jet head onto the printing paper. After completing the cleaning of the ink jet head, the print data stored in the storing means is printed on a portion of the printing paper used for the cleaning immediately following and below the cleaning area.

Accordingly, it is not necessary to provide a special mechanism for the cleaning of the ink jet head independently of the regular printing mechanism as was the case in the prior art. As a result, the cleaning of the ink jet head can be carried out with a simple structure at a low cost and high-quality print can always be obtained. Furthermore, it is not necessary to provide a special wiping member for the cleaning of the ink jet head, rather the printing paper employed for the regular printing operation is used as a wiping member. Accordingly, the task of replacing the special wiping member, necessary in the prior art, is eliminated and the operator is relieved from such a troublesome task. Moreover, following cleaning, a test print is carried out on a portion of the printing paper immediately below that used for the cleaning. Therefore, the waste of new printing paper for test printing is avoided and the operator can easily and surely confirm whether the cleaning is satisfactory and whether the operation of each section of the ink jet printer is normal.

BRIEF DESCRIPTION OF THE DRAWINGS

The present invention will be described with reference to the drawings, in which:

FIG. 6B is a table of labels for the flowchart of FIG. 6A; and

DESCRIPTION OF THE PREFERRED EMBODIMENT

Figure 1:
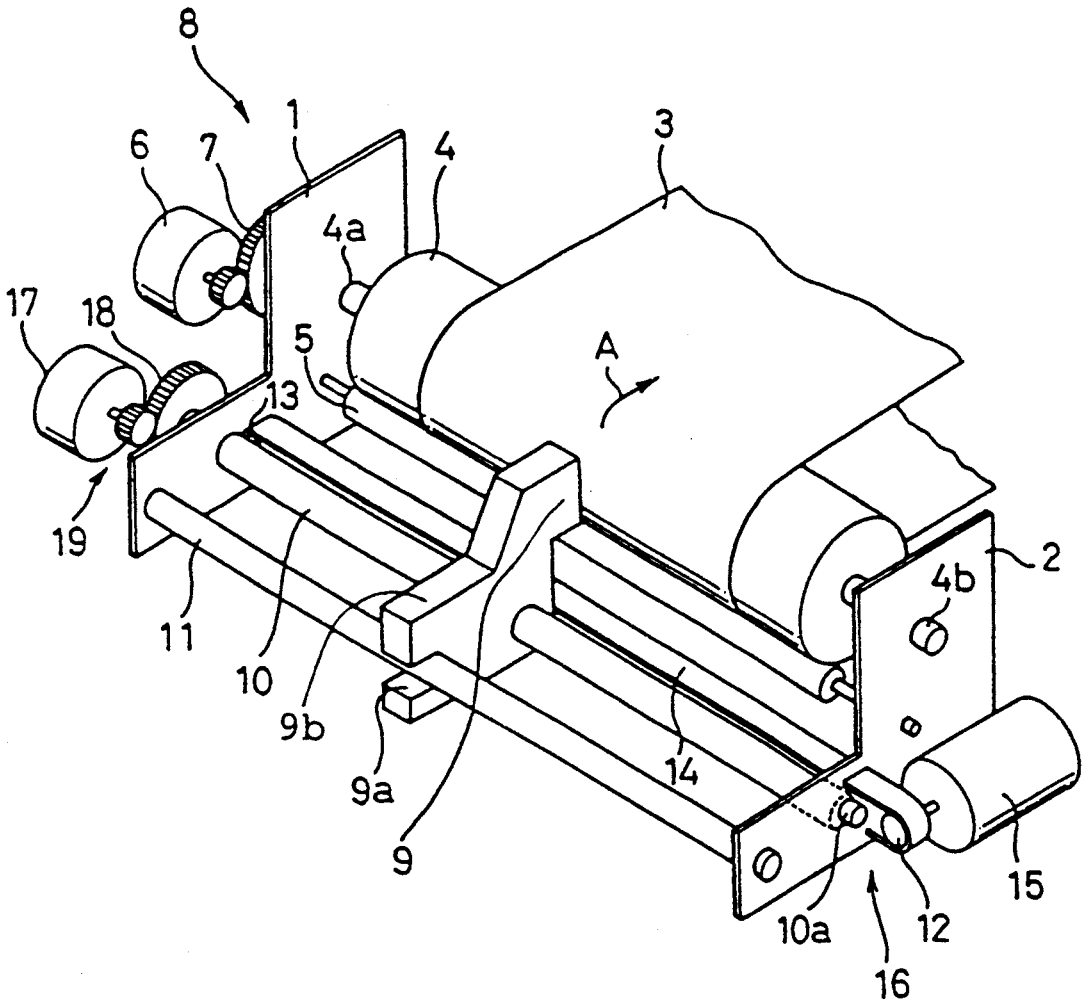
FIG. 1 is a perspective view of an essential part of an ink jet printer according to a preferred embodiment of the present invention.

There will now be described a preferred embodiment of the present invention with reference to the drawings.

First, the basic structure of an ink jet printer to which the present invention is applied will be described with reference to FIGS. 1 and 2. A printer body of the ink jet printer shown includes a pair of side plates 1,2. There are provided between the side plates 1,2 a rotatable platen 4 formed of rubber, for example, for supporting printing paper 3, and a rotatable nip roller 5, which is located below the platen 4 with the printing paper 3 interposed therebetween so that the printing paper 3 is nipped between the platen 4 and the nip roller 5. The platen 4 is provided with a pair of opposite shaft portions 4*a* and 4*b* rotatably supported in the side plates 1,2 respectively. Outside the side plate 1 are located a paper feed motor 6 and a gear mechanism 7 for transmitting rotation of the paper feed motor 6 to the shaft portion 4*a*. With this structure, the platen 4 is rotated via the gear mechanism 7 by the paper feed motor 6 and the printing paper 3, nipped between the platen 4 and the nip roller 5, is accordingly fed in the direction of arrow A. Thus, the paper feed motor 6, the gear mechanism 7, the platen 4 and the nip roller 5 constitute a paper feed mechanism 8. A paper sensor 22 for detecting the presence of the printing paper 3 is located in the vicinity of the platen 4. As shown in FIG. 2, a paper supply mechanism 4*c*, for supplying the printing paper 3 to the platen 4, is provided behind the platen 4. Further, a power switch 34 is provided on the printer body.

Figure 2:
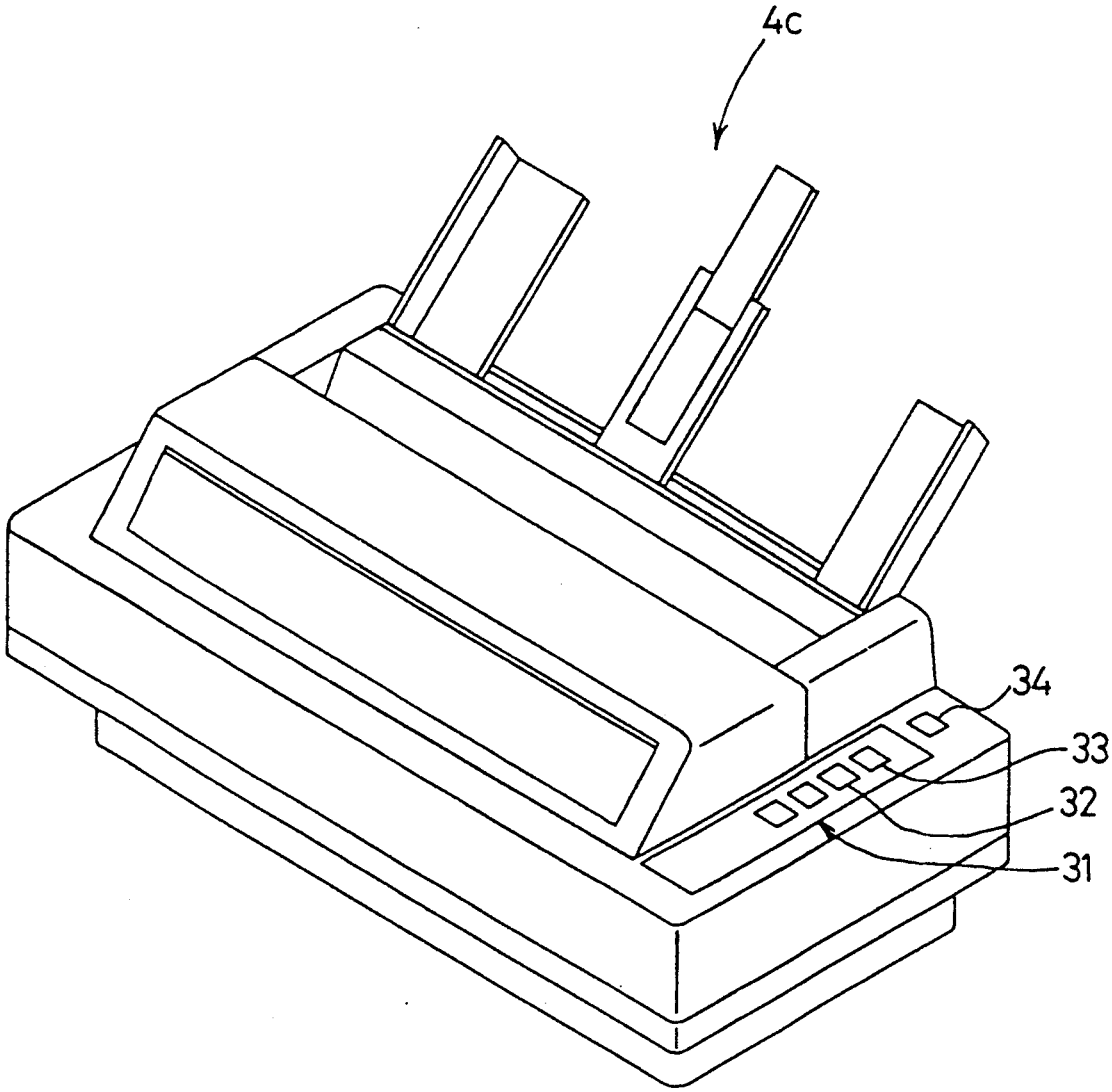
FIG. 2 is a general perspective view of a body of the ink jet printer.
Figure 3:
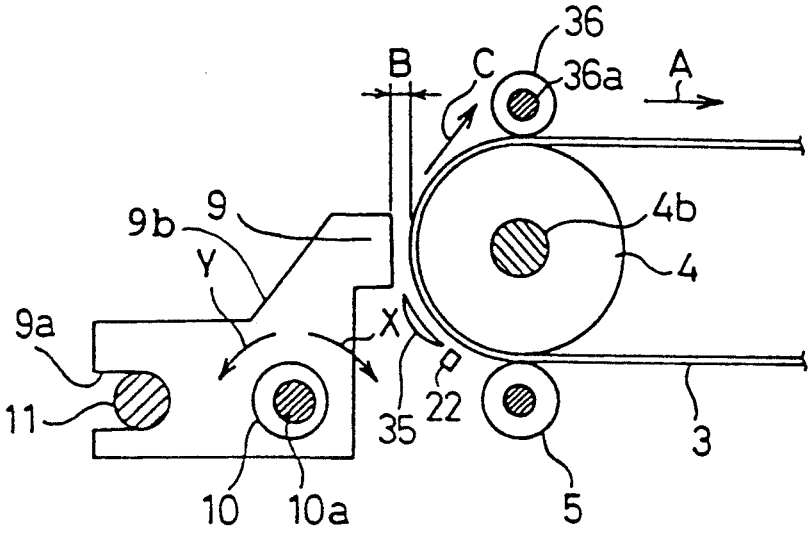
FIG. 3 is a vertical sectional view of an essential part of the ink jet printer in a regular printing operation.
Figure 4:
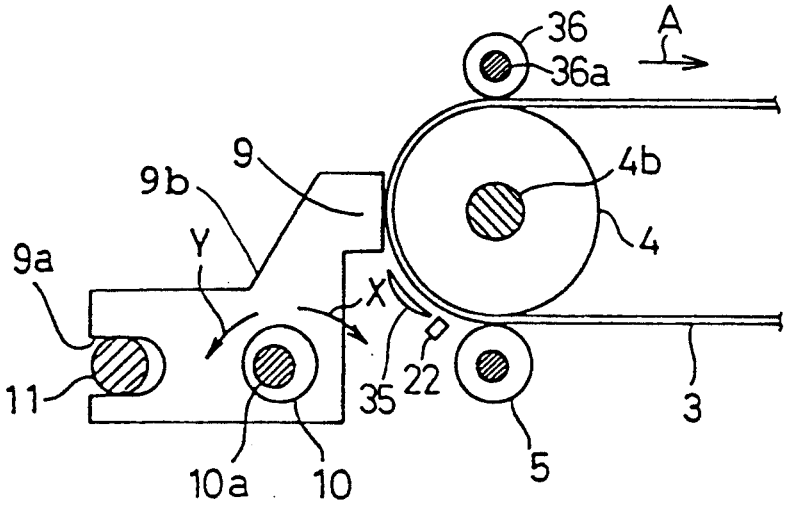
FIG. 4 is a view similar to FIG. 3 in a cleaning operation.

As shown in FIGS. 1, 3 and 4, an ink jet head 9 for printing characters onto the printing paper 3 is provided in a facing relationship to the platen 4. The ink jet head 9 is provided at its front end with a plurality of nozzles arranged vertically or obliquely. The ink jet head 9 is an on-demand type printing head adapted to be controlled to selectively eject liquid ink particles from the nozzles so as to make the liquid ink particles adhere to the printing paper 3 at necessary positions only. A guide bar 10 extends parallel the platen 4 between the side plates 1,2. A carriage 9*b* for mounting the ink jet head 9 thereon is slidably supported on the guide bar 10. Further, a fixed bar 11 extends in parallel to the guide bar 10 between the side plates 1,2. The carriage 9*b* is formed at its rear end with a recess 9*a* loosely engaging the fixed bar 11. Thus, the carriage 9*b* is laterally movable, together with the ink jet head 9, supported by the guide bar 10 and the fixed bar 11. The lateral movement of the carriage 9*b* along the guide bar 10 is effected by a head driving mechanism 16 including a pair of pulleys 12 and 13, a belt 14 fixed to the carriage 9*b* and wound around the pulleys 12 and 13, and a driving motor (carriage motor) 15 for rotating the pulley 12.

Although not shown in FIG. 1, but shown in FIGS. 3 and 4, a paper guide 35 is provided under the platen 4 and a paper bail roller 36 is provided above the platen 4. The paper bail roller 36 is displaceably supported by a roller shaft 36*a* so that when the printing paper 3 is intended to be mounted onto the platen 4, the paper bail roller 36 is moved upwardly away from the platen 4 and after the printing paper 3 is mounted on the platen 4, the paper bail roller 36 is pressed against the platen 4 with the printing paper 3 interposed therebetween. The paper guide 35 and the paper bail roller 36 serve to guide the printing paper 3 along the circumference of the platen 4 and they are similar to those employed in a general printer.

Figure 5:
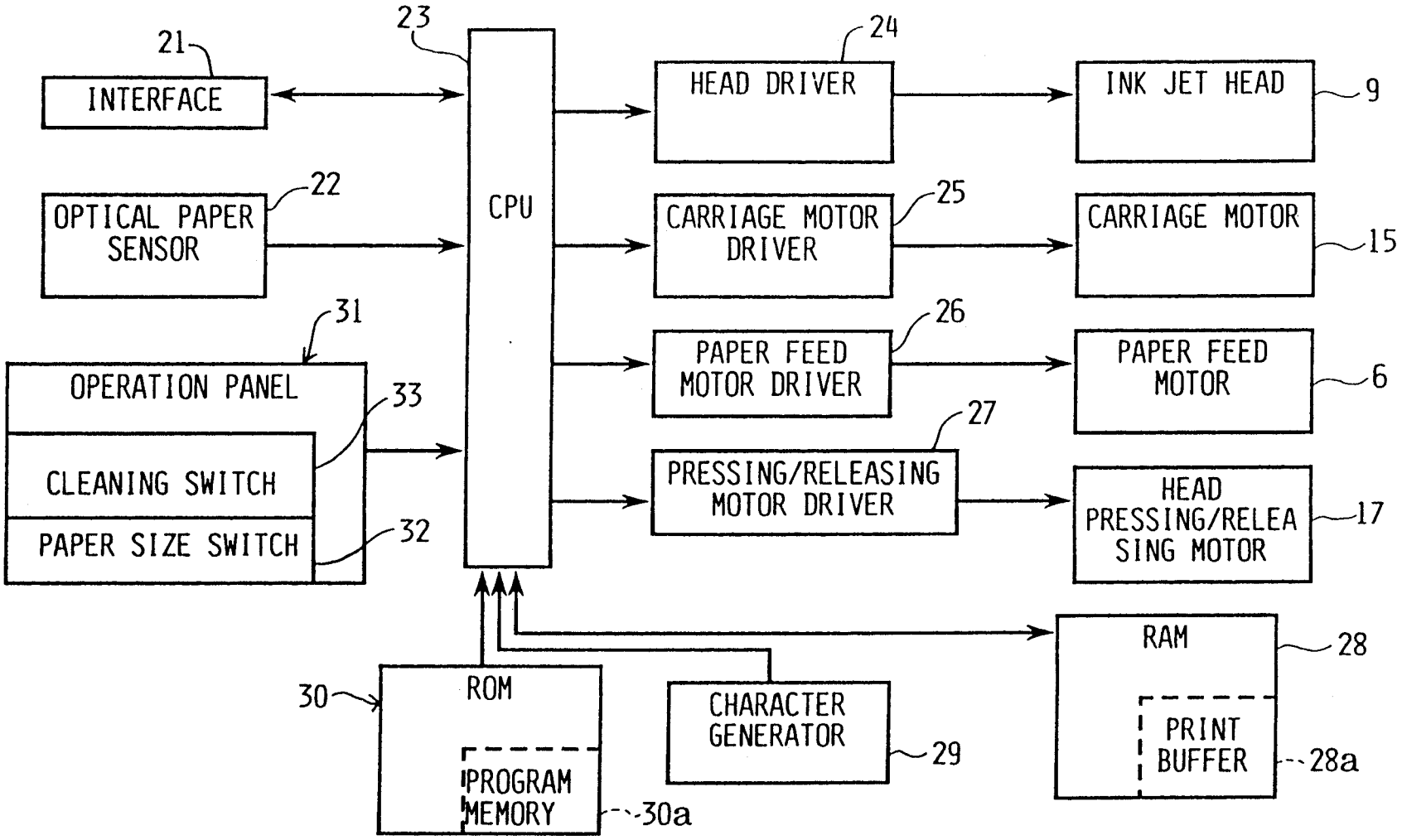
FIG. 5 is a block diagram showing the structure of a control device provided in the ink jet printer.

The printer body is provided with a control device as shown in FIG. 5. Reference numeral 23 designates a CPU (central processing unit) for controlling operations of the printer. Connected to the CPU 23 is an interface 21 for effecting intercommunication of print data from and to external host equipment such as a computer. Also connected to the CPU 23 is the optical paper sensor 22 for detecting whether the printing paper 3 has been supplied to a nip position between the platen 4 and the nip roller 5. Further connected to the CPU 23 are a head driver 24 for driving the ink jet head 9 to effect ejection of ink, a carriage motor driver 26 for driving the carriage motor 15, a paper feed motor driver 25 for driving the paper feed motor 6, and a pressing-/releasing motor driver 27 for driving a head pressing-/releasing motor 17 to be described below.

Also connected to the CPU 23 is a RAM 28 to be used as a print buffer 28*a* for temporarily storing print data input from the external host equipment through the interface 21 for the purpose of controlling a print operation and as a working area for various control operations. A character generator 29 storing various dot patterns corresponding to numerous characters to be printed is also connected to the CPU 23. In addition, a ROM 30 serving as a program memory 30*a* storing various programs for executing various operations and as an area storing information necessary for various operations is connected to the CPU 23. Stored in the program memory 30*a* is a program for executing a regular print operation such that regular printing is carried out according to print data input from the external host equipment, a program for executing a test print operation such that the dot patterns corresponding to the numerous characters are sequentially read from the character generator 29 and printed independently and irrespectively of the external host equipment, and a program for executing a cleaning operation such that the nozzles of the ink jet head 9 are cleaned as will be described in detail below. The test print is carried out for the purpose of diagnosing whether or not the ink jet printer is operating normally.

Further, an operation panel 31, connected to the CPU 23, is provided with a paper size switch 32 for designating a paper size and direction such as A4 longitudinal, A4 transverse, B5 longitudinal or B5 transverse, a cleaning switch 33 for instructing the CPU to clean the ink jet head 9, and switches for instructing the CPU to perform other functions. These switches, such as the paper size switch 32 and the cleaning switch 33 of the operation panel 31 are manually operated by the operator. The CPU 23 controls each section of the printer according to the programs and the information stored in the ROM 30 to control the printer as a whole.

Within the above structure, the ink jet head 9 is operated to eject the liquid ink particles from the necessary nozzles in accordance with the dot patterns corresponding to the characters to be printed while being simultaneously moved laterally along the platen 4 by the head driving mechanism 16, thereby executing the printing of the characters onto the printing paper 3 set on the platen 4. After the printing of the characters in one line is ended, the printing paper 3 is fed by one line in the direction of arrow A by the paper feed mechanism 8 to execute the printing of the characters in the next line. Such an operation is repeated for the subsequent lines. During this regular printing operation, the front end of the ink jet head 9 is spaced by a fine distance B from the printing paper 3 as shown in FIG. 3.

It is necessary to occasionally clean the ink jet head 9 to prevent clogging of the nozzles of the ink jet head 9 or a reduction in printing quality due to the depositing of an ink residue or dirt at the nozzles will occur.

The mechanism for cleaning the ink jet head 9 will be described with reference to FIGS. 1, 3 and 4.

The guide bar 10 is integrally formed at its opposite ends with eccentric shaft portions 10*a* (only one being shown) eccentric from the axis of the guide bar 10. The eccentric shaft portions 10*a* are rotatably supported in the side plates 1,2. Accordingly, the guide bar 10 is rotatable in opposite directions as depicted by arrows X and Y about the eccentric shaft portions 10*a*. In association with the rotation of the guide bar 10 in the opposite directions, the ink jet head 9 moves in opposite directions so as to come into pressure contact with and be retracted from the platen 4. As shown in FIG. 1, there are provided, to the outside of the side plate 1, a head pressing/releasing motor 17 capable of being reversibly rotated and a gear mechanism 18 for transmitting the rotation of the head pressing/releasing motor 17. With this construction, when the pressing/releasing motor 17 is rotated in a normal (forward) or reverse direction, the guide bar 10 is rotated through the gear mechanism 18 in the direction of arrow X or Y about the eccentric shaft portions 10*a* to thereby move the ink jet head 9 toward or away from the platen 4. The head pressing-/releasing motor 17, the gear mechanism 18 and the eccentric shaft portions 10*a* constitute the head pressing/releasing mechanism 19 shown in FIG. 1. Like the other mechanisms, the head pressing/releasing mechanism 19 is controlled by the control device mentioned above. As shown in FIG. 3, for printing operations the ink jet head 9 is maintained at a position which is a predetermined distance B from the printing paper 3 set on the platen 4 under the control of the control device. In this preferred embodiment, the distance B is 1.1 mm.

Figure 6A:
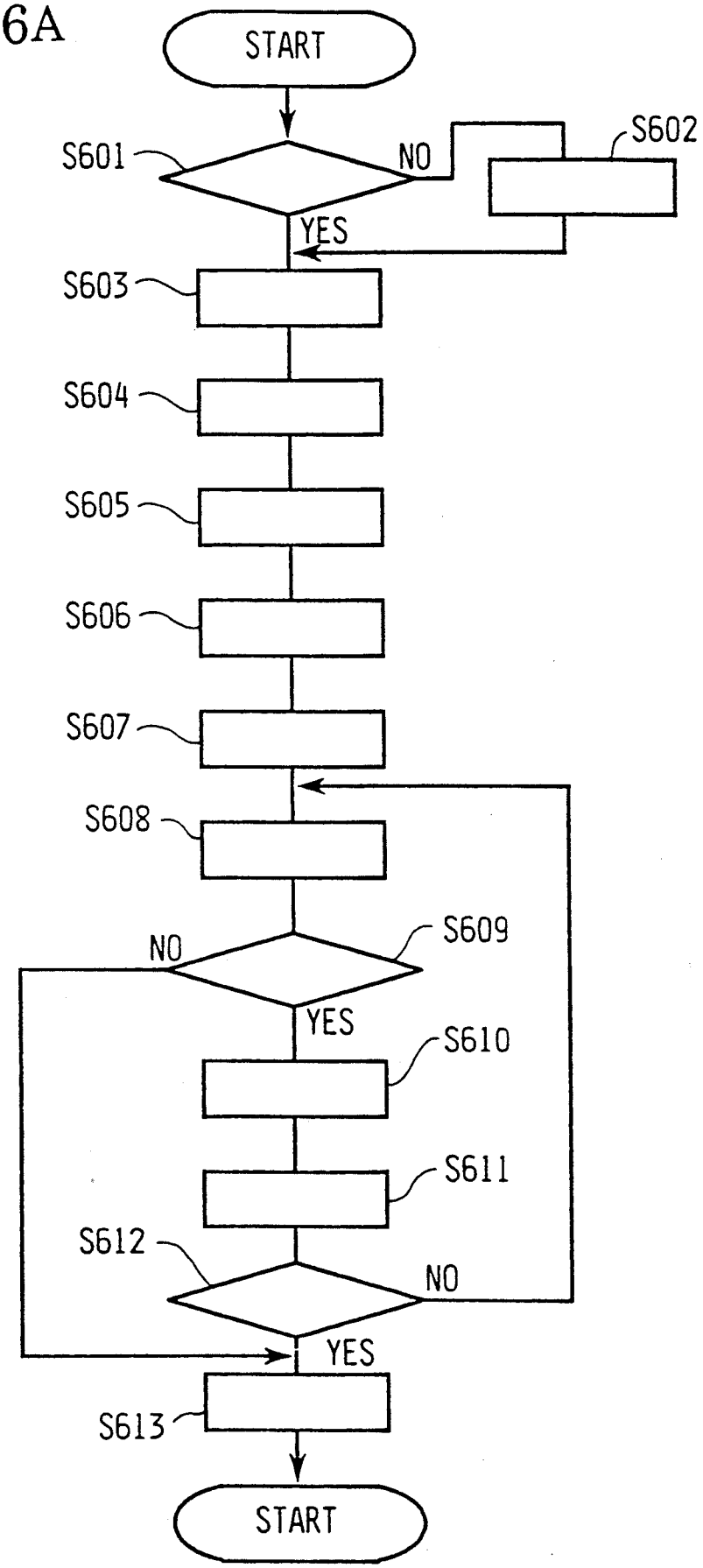
FIG. 6A is a flowchart showing a cleaning and test printing operation in the preferred embodiment.

The cleaning operation for the ink jet head 9 and the test printing operation will be described with reference to the flowchart shown in FIGS. 6A and 6B.

When the power switch 34 of the operation panel 31 is turned on to supply power to the printer, or when the cleaning switch 33 is turned on under the condition where the power switch 34 has been already turned on, the process of executing the cleaning and the test printing operations is started. First, it is determined whether or not the printing paper 3 has been detected by the paper sensor 22 (step S601). If the printing paper 3 has not been detected in step S601, the printing paper 3 is fed until it is detected by the paper sensor 22 (step S602). If the printing paper 3 has been detected in step S601, or after the printing paper 3 is fed until it is detected by the paper sensor 22 in step S602, the printing paper 3 is further fed by a first predetermined amount (step S603). The first predetermined amount is a feed amount of the printing paper 3 from a position opposed to the paper sensor 22 to a position opposed to the nozzles of the ink jet head 9. Then, the carriage 9*b* is moved laterally to a position where the ink jet head 9 faces a laterally central position of the printing paper 3, set on the platen 4, along a printing line (step S604).

Then, the head pressing/releasing motor 17 is driven to operate the head pressing/releasing mechanism 19 so as to move the ink jet head 9 in the direction of arrow X (FIGS. 3 and 4) to thereby press the nozzles of the ink jet head 9 against the printing paper 3 set on the platen 4 (step S605). With the ink jet head 9 pressed against the printing paper 3, the paper feed motor 6 is driven to operate the paper feed mechanism 8 by rotating the platen 4 and feeding the printing paper 3 by a second predetermined amount. As a result, the printing paper 3 slides across the nozzles of the ink jet head 9 by the second predetermined amount. In this preferred embodiment, the second predetermined amount is set to be two inches. Thus, the printing paper 3 wipes the nozzles of the ink jet head 9 to thereby clean them of attached ink residue and dirt (step S606).

Thereafter, the head pressing/releasing motor 17 is driven again to operate the head pressing/releasing mechanism 19 so as to move the ink jet head 9 in the direction of arrow Y (FIGS. 3 and 4) to retract the ink jet head 9 by the predetermined amount B which is a normal gap used in the regular printing operation (step S607).

After thus ending the cleaning of the ink jet head 9, a test print is carried out on the printing paper 3, used for the cleaning, in a blank space just below the cleaning area of the printing paper 3.

More specifically, after the cleaning operation, the ink jet head 9 is first returned to a left end of the printing paper 3 and the printing paper 3 is fed by one line in a line feed operation (step S608). Then, it is determined whether or not the printing paper 3 is detected by the paper sensor 22 (step S609). If the printing paper 3 is not detected by the paper sensor 22 in step S609, that is, the end of the paper has advanced beyond sensor 22, it is determined that there is insufficient blank space for the test print on the printing paper 3 and the printing paper 3 is ejected without carrying out the test print (step S613).

On the other hand, if the printing paper 3 is detected as present by the paper sensor 22 in step S609, a character data of one line is written into the print buffer 28*a* according to a paper size designated by the paper size switch 32 (step S610). That is, the CPU 23 sequentially reads a set of printable character data stored in the ROM 30 and writes the same into the print buffer 28*a* irrespective of the external host equipment. Then, according to the character data written into the print buffer 28*a*, the corresponding dot pattern is read from the character generator 29, and the character data written in the print buffer 28*a* is printed, according to the dot pattern read above, by the ink jet head 9 as it is moved along the print line by the carriage motor 15

(step S611). After ending the printing of the character data of one line, it is determined whether or not all the printable character data has been written into the print buffer 28*a* (step S612). If any character data having not yet been written into the print buffer 28*a* are left, the processes of steps S608 to S611 are again executed to print the remaining character data if sufficient blank space is left on the bottom of the current printing paper 3. On the other hand, if all the printable character data have been already written into the print buffer 28*a* in step S612, the test print is ended and the platen 4 is rotated to eject the printing paper 3 in the direction of arrow A (step S613).

Figure 7:
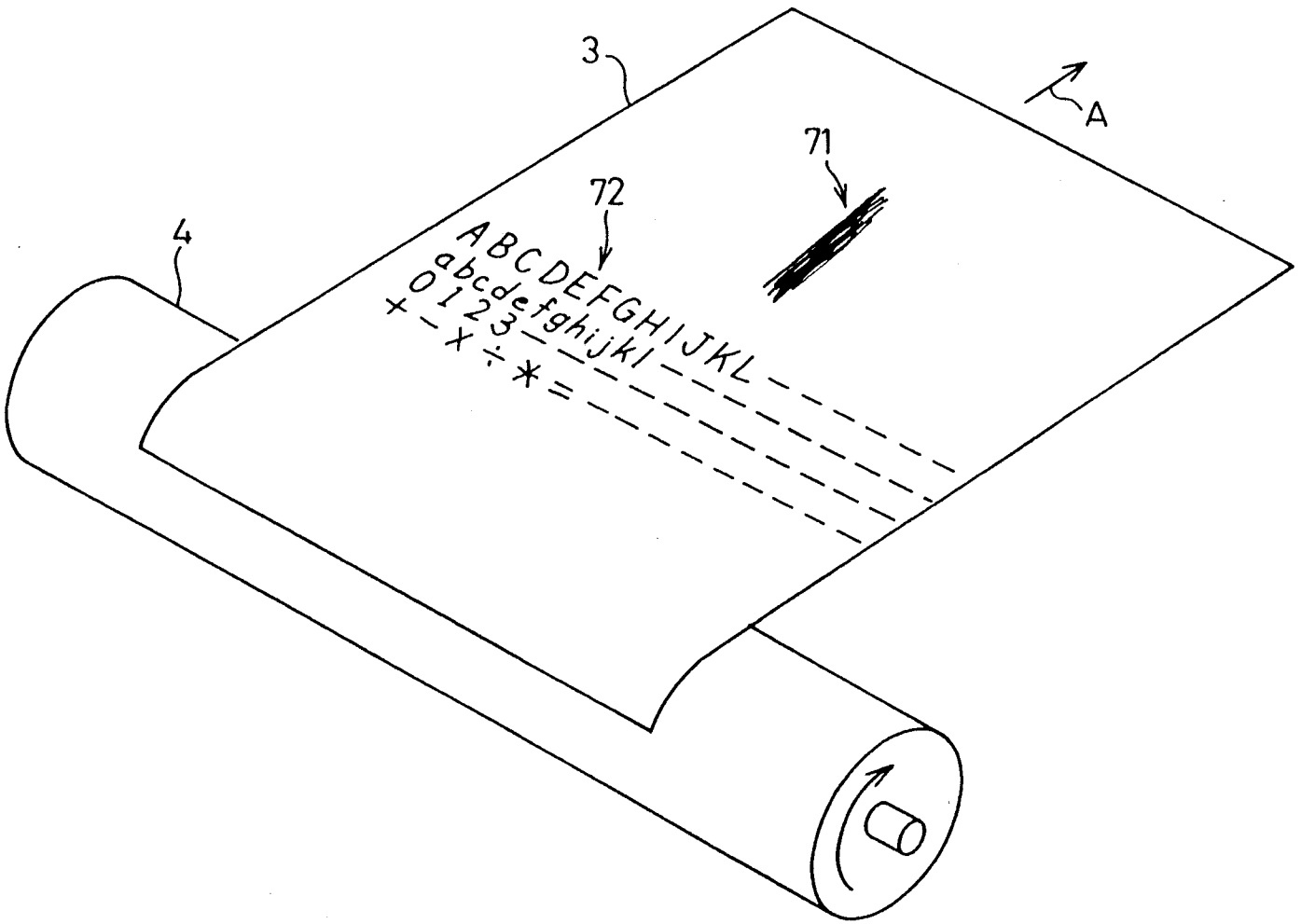
FIG. 7 is a perspective view of a printing paper used for the cleaning and test printing operation.

The result of the cleaning of the ink jet head 9 and the test print is shown in FIG. 7. Referring to FIG. 7, reference numeral 71 denotes a stain caused by the residue and dirt removed from the ink jet head 9 and attached to the printing paper 3 by the cleaning operation and reference numeral 72 denotes a set of characters printed on the same printing paper 3 by the test printing operation.

According to the preferred embodiment mentioned above, a buildup, such as an ink residue, attached on the nozzles of the ink jet head 9 can be cleaned off every time the power switch 34 is turned on, or the cleaning switch 33 is turned on when the power switch 34 has been previously turned on, thereby preventing a reduction in print quality due to such a buildup. The result is print having a consistently high quality. Further, unlike the prior art ink jet printer, no special cleaning mechanism is provided, or needed, that is independent of the printing section. Accordingly, the cleaning of the ink jet head 9 can be accomplished with a simple structure and at a low cost. Further, unlike the prior art ink jet printer, no special wiping member is provided, but the cleaning of the ink jet head 9 is effected by using the printing paper 3. Accordingly, the unnecessarily burdensome task of replacing the wiping member necessary in the prior art can be eliminated. Further, whether or not the printing paper 3 is properly set on the platen 4 is reliably detected by the paper sensor 22 and, if the printing paper 3 is not detected by the paper sensor 22, the cleaning of the ink jet head 9 is not started until printing paper is present. Accordingly, there is no possibility that the ink jet head 9 is directly pressed against the platen 4, without interposing the printing paper 3 therebetween, to stain or damage the platen 4 due to the sliding contact of the platen 4 with the ink jet head 9.

Further, if a blank space is left on the printing paper 3 below the area used for the cleaning of the ink jet head 9, a test print is carried out automatically and immediately after the end of the cleaning. Accordingly, not only can the result of the cleaning be immediately confirmed by the test print, but also whether or not each controller and each mechanism are operating normally can be confirmed before carrying out a regular printing operation. Lastly, the printing paper 3 used for the test print is the same paper that has already been used for the cleaning of the ink jet head 9 and the paper is to be ejected later. Accordingly, it is not necessary to use new printing paper for the test print thus saving printing paper.

Although the ink jet head 9 is moved forward or backward (i.e., in the direction of arrow X or Y) by the head pressing/releasing mechanism 19 to come into pressure contact with or be retracted from the printing paper 3 set on the platen 4 in the above preferred embodiment, the paper feed mechanism as a unit may be made movable forward or backward without moving the ink jet head 9 so as to bring the printing paper together with the platen 4 into pressure contact with the ink jet head.

Further, although the printing paper 3 set on the platen 4 is moved in the direction of arrow A by the paper feed mechanism 8 to effect a sliding of the printing paper 3 relative to the ink jet head 9 in the above preferred embodiment, the ink jet head 9 may be moved laterally along guide bar 10 while the printing paper 3 is kept stationary.

In a modification, the ink jet head 9 may be obliquely moved as shown by an arrow C in FIG. 3, so as to simultaneously effect the pressing and the sliding relatively to the printing paper. In this case, the head pressing/releasing mechanism and the head sliding mechanism can be assembled as a single mechanism.

Further, although the cleaning of the ink jet head 9 is started every time the power is applied in the preferred embodiment, the cleaning may be carried out when a head drive time becomes more than a predetermined time by providing a counter for accumulating the head drive time in the control section.

Additionally, the cleaning of the ink jet head 9 may be carried out by using any cleaning paper rather than a normal printing paper.

It is to be understood that other various modifications may be made without departing from the scope of the present invention.

What is claimed is:

1. An ink jet printer of the present invention, comprises:

a paper supporting mechanism for supporting a printing paper;

an ink jet head for ejecting ink onto the printing paper supported by the paper supporting mechanism to carry out printing;

instruction means for instructing cleaning of the ink jet head;

a pressing mechanism for effecting pressure contact between the ink jet head and the printing paper support by the paper supporting mechanism in response to an instruction from the instruction means;

a slide moving mechanism for effecting relative sliding movement of the ink jet head and the printing paper under the pressure contact condition effected by the pressing mechanism for cleaning the ink jet head;

restoring means for restoring a distance between the ink jet head and the printing paper to a distance predetermined for a regular printing operation after the relative sliding movement effected by the slide moving mechanism;

a regular moving mechanism for effecting relative movement of the ink jet head and the printing paper where the distance between the ink jet head and the printing paper is equal to the predetermined distance; and printing means for printing a test print data by driving the ink jet head over a portion of the printing paper immediately following and below a relative slide moving area of the printing paper defined by the slide moving mechanism while the ink jet head and the printing paper are relatively being moved by the regular moving mechanism after a restoring operation effected by the restoring means.

2. An ink jet printer as claimed in claim 1, further comprising:

a paper detecting means for detecting whether the printing paper is at a printable position.

3. An ink jet printer as claimed in claim 2, further comprising:

a print canceling means, wherein said reading and printing means only read and print the test print data when said detecting means indicates the printing paper is at the printable position, and when the detecting means does not indicate a printable position, said canceling means ejects the printing paper without printing the test print data.

4. An ink jet printer as claimed in claim 3, further comprising:

storing means for storing the test print data; and reading means for reading the test print data stored in the storing means.

5. A cleanable print head for an ink jet printer comprising:

a printer frame;

a rotatable platen for supporting and advancing a paper sheet;

a print head carriage for mounting the print head;

a guide bar mounted in the printer frame parallel to the platen, said print head carriage slidably mounted on said guide bar;

a drive means for moving said print head carriage along the guide bar;

contacting means for moving the print head against the paper sheet supported by the platen and retracting the print head to a print position, said contacting means comprising eccentric shaft portions at each end of said guide bar, said eccentric shaft portions providing a rotatable mounting of said guide bar in said frame, and a drive means for rotating said guide bar;

instruction means for instructing a cleaning operation of the print head; and control means for controlling the cleaning operation by relatively moving the paper sheet and the print head while in contact.

6. A cleanable print head as claimed in claim 5, further comprising selection means for identifying a size of paper sheet paper being used.

7. A cleanable print head as claimed in claim 6, further comprising:

storage means for storing test print data; and a sensor for indicating to said control means whether sufficient space remains on the paper sheet based on the size of the paper sheet being used to print the test print data after the cleaning operation.

* * * * *